US006976443B2

(12) United States Patent
Oma et al.

(10) Patent No.: US 6,976,443 B2
(45) Date of Patent: Dec. 20, 2005

(54) CRUDE OIL TRANSPORTATION SYSTEM

(76) Inventors: Narve Oma, Grannesgletta 148, 4052 Royneberg (NO); Tor Erik Hildén, Håvollveien 14, N-4017 Stavanger (NO); Kjell Egil Helgoy, Lobalsken, N-4158 Bru (NO); Trygve G. Egge, Håbakken 18, N-4041 Hafrsfjord, Stavanger (NO)

( * ) Notice: Subject to any disclaimer, the term of this patent is extended or adjusted under 35 U.S.C. 154(b) by 0 days.

(21) Appl. No.: 10/741,392

(22) Filed: Dec. 19, 2003

(65) Prior Publication Data

US 2005/0016431 A1 Jan. 27, 2005

Related U.S. Application Data

(60) Provisional application No. 60/435,156, filed on Dec. 20, 2002.

(51) Int. Cl.[7] ..... B63H 25/42; B65B 1/04
(52) U.S. Cl. ..... 114/144 B; 141/387
(58) Field of Search ..... 144/144 B, 74 R, 144/74 T; 441/4; 166/352, 354; 141/387

(56) References Cited

U.S. PATENT DOCUMENTS

| | | | | |
|---|---|---|---|---|
| 5,803,779 | A * | 9/1998 | Horton, III | 441/4 |
| 6,230,809 | B1 * | 5/2001 | Korsgaard | 166/352 |
| 6,390,733 | B1 * | 5/2002 | Burbage et al. | 405/203 |
| 6,517,290 | B1 * | 2/2003 | Poldervaart | 405/224.2 |
| 6,688,348 | B2 * | 2/2004 | Fontenot | 141/387 |
| 6,817,809 | B2 * | 11/2004 | Choi et al. | 405/195.1 |

FOREIGN PATENT DOCUMENTS

WO WO 01/58749 A1 * 8/2001

* cited by examiner

*Primary Examiner*—Andrew D. Wright
(74) *Attorney, Agent, or Firm*—Strasburger & Price, LLP; Alan R. Thiele

(57) ABSTRACT

A crude oil transportation system uses a dynamically positionable floating crude oil storage and offloading vessel and a dynamically positionable shuttle tanker. The dynamically positionable floating crude oil storage and offloading vessel is a self-contained unit including a flexible transfer hose for connecting to the production platform and a flexible discharge hose for connection to the dynamically positionable shuttle tanker.

5 Claims, 4 Drawing Sheets

CRUDE OIL TRANSPORTATION SYSTEM

REFERENCE TO RELATED APPLICATION

This application claims priority from U.S. Provisional Patent Application Ser. No. 60/435,156 filed Dec. 20, 2002.

BACKGROUND OF THE INVENTION

1. Field

The present invention pertains to a transportation system which enables the use of a dynamically positioned Floating Storage and Offloading vessel (FSO) with shuttle tankers for moving crude oil onshore from an offshore crude oil production system such as a tension leg platform, a semi submersible platform, a spar, or a compliant movable platform such as those located; for example, in the Gulf of Mexico.

2. Background

The production of hydrocarbons, particularly crude oil from wells which tap into subsea reservoirs, such as those located in the Gulf of Mexico, is facilitated by multiple large offshore production systems located near one or more subsea wells in an oil field. These production systems are typically used for the initial removal of contaminants from the crude oil extracted from subsea reservoirs. Once the first round of contaminants has been extracted, the crude oil is transported from the offshore production system to onshore refineries or storage facilities through a network of pipelines laid on the sea bottom. However, as new wells are being drilled into reservoirs located in deeper and deeper water and in regions where the sea bottom includes rough or uneven terrain such as steep cliffs and deep canyons, the use of pipelines laid directly onto the sea bottom becomes increasingly complex and prohibitively expensive. Accordingly, there is a need in the art for a system which will enable the economical transport of crude oil produced by offshore production systems located in deep water to onshore refineries or storage facilities.

SUMMARY

The disclosed transportation system enables the economical transport of crude oil produced by off-shore production systems located in deep water to onshore refineries or storage facilities.

The transportation system of the present invention is centered around a dynamically positioned floating storage and offloading vessel (DPFSO) which provides temporary storage for the crude oil produced by an offshore production system. The disclosed transportation system also includes the use of dynamically positionable shuttle tanker(s) to transport the crude oil from the DPFSO to storage terminals or refineries onshore.

The DPFSO portion of the disclosed transportation system is capable of maintaining both position and separation distance with respect to an offshore production system by using both its main propulsion and steering systems together with auxiliary propulsion equipment such as positionable thrusters located on the bow and on the sides of the hull. By use of both the main and auxiliary propulsion systems, the DPFSO will always be kept within a predetermined locus of positions such that an unexpected failure of the positioning system ("drive off" or "drift off") will not result in collision with the offshore production platform.

The dynamic positioning (DP) system on the FSO includes appropriate functionality redundancy according to IMO DP Class II. This implies that those systems designed for controlling the position of the FSO have a redundant backup. Thus, the DPFSO will be able to maintain its position under regular weather conditions even if one or more portions of the main or auxiliary propulsion systems fail. During severe weather conditions such as hurricane conditions which require closing down offshore production platforms and evacuation of the crew, the DPFSO can be disconnected from the production platform until the weather conditions improve.

BRIEF DESCRIPTION OF THE DRAWING FIGURES

A better understanding of the crude oil transportation system of the present invention may be had by reference to the drawing figures, wherein.

DESCRIPTION OF THE EMBODIMENTS

Figure 1:
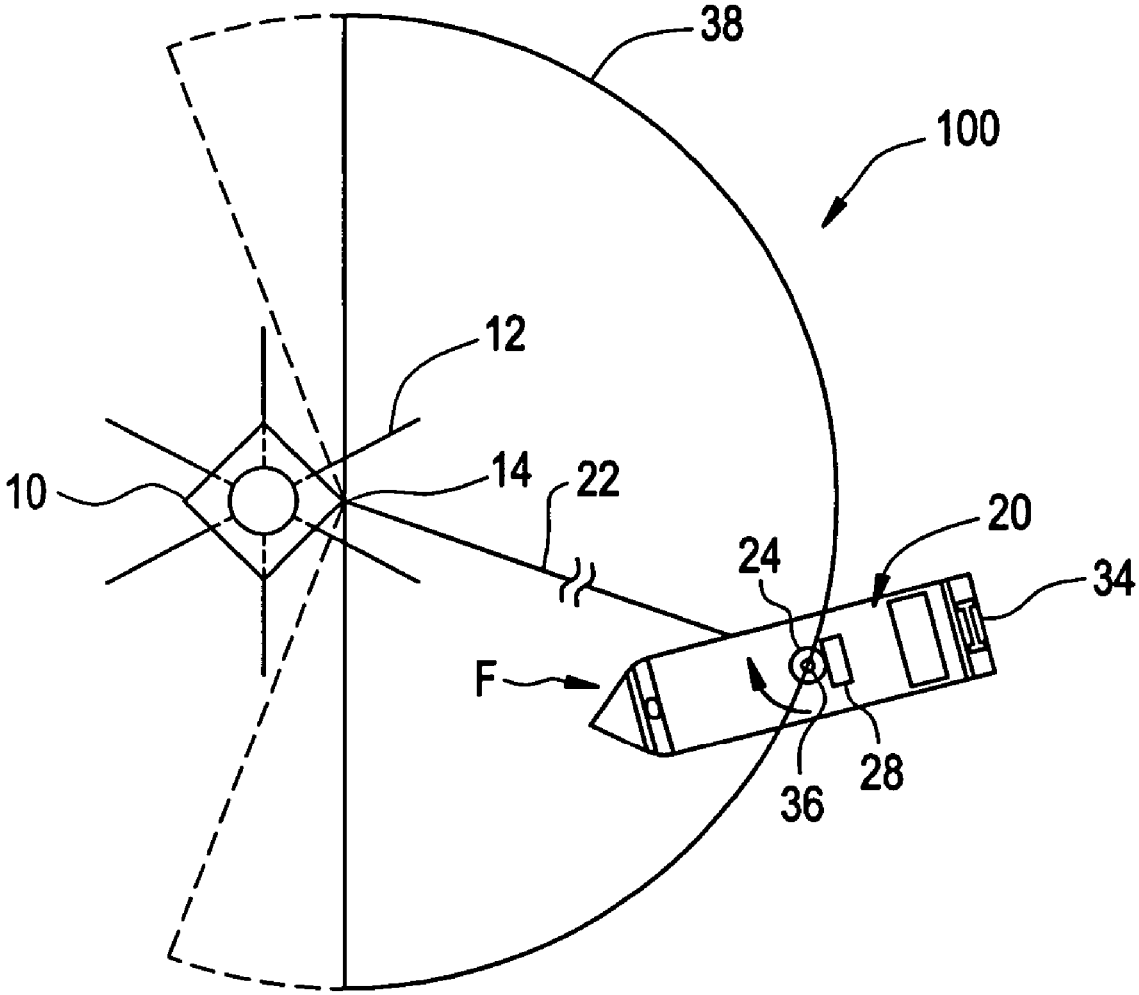
FIG. 1 is a schematic plan view of the relative position of the disclosed DPFSO to an offshore production platform in the receiving mode.

FIG. 1 is a schematic plan view of the transportation system 100 of the present invention in its "receiving mode." Specifically, a fixed, floating, or movable offshore production platform 10 is connected to the sea bottom using one of a variety of different mooring and stabilization systems 12. Specifically, the disclosed transportation system 100 may be used with a variety of different crude oil production systems such as tension leg platforms, semi-submersible platforms, spars, compliant movable platforms, or fixed platforms connected directly to the sea bottom.

A dynamically positionable floating crude oil storage and offloading vessel (DPFSO) 20 is located at a movable separation distance of approximately 500 meters away from the offshore production platform 10. As shown in FIG. 1, the movement of the DPFSO 20 is along a predefined arc 38 representing a locus of acceptable positions on the leeward side of the production platform 10. By assuring a locus of predetermined positions, the prevailing winds and currents F will not cause the DPFSO 20 to collide with the production platform 10 in the event of a power or a control failure.

The DPFSO 20, in its "receiving mode," operates its dynamic positioning system to "weather vane." The term "weather vaning" implies that the ship's dynamic positioning system always will keep the long axis of the DPFSO 20 in a position with respect to wind and wave forces where its fuel consumption is minimized. The DPFSO 20 can rotate 360 degrees about its weather vaning center 36 to achieve the optimum position for stability and minimal fuel consumption.

As shown in FIG. 1, the DPFSO 20 includes an opening, or what is known in the industry as a "moon pool" 24, generally in the center of the vessel 20. In the preferred embodiment, the center of rotation 36 for weather vaning by the DPFSO 20 is located at the center of the moon pool 24. Those of ordinary skill in the art will understand that the moon pool 24 and the center of rotation 36 may also be placed at other locations on the DPFSO 20, as desired, depending on the characteristics of the DPFSO 20.

To assure that the DPFSO 20 is not pointed directly toward the offshore production platform 10 in the event of a system failure, the DPFSO 20 will be located so that the production platform 10 is not within the travel path of the DPFSO 10 in the event that the dynamic positioning system for the DPFSO 20 fail. The present invention is based on the idea that the dynamic positioning system is programmed such that the DPFSO 20 is able to be positioned at any point around the circumference of a predetermined operating locus of points 38 drawn around the offshore production platform 10 while, at the same time, operating in its "weather vane" mode, i.e., rotating about center 36 of the moon pool 24.

The DPFSO 20 is designed to take on a load of crude oil and discharge a load of crude oil substantially as a self contained unit. Specifically, there is a flexible transfer hose 22 connected between the DPFSO 20 and the offshore production platform 10. In most offshore operations, this hose 22 typically has a diameter of about 6 inches to 8 inches. This flexible transfer hose 22 is connected to and stored entirely on board the DPFSO 20. Once the flexible transfer hose 22 is offloaded from the DPFSO 20 and connected to the offshore production platform 10, the crude oil that is produced by the offshore production platform 10 can be transferred from the offshore production platform 10 to the DPFSO 20 through this flexible transfer hose 22. Typically, the flexible transfer hose 22 is attached to the offshore production platform 10 using a hang-off device 14 for the flexible transfer hose 22. This hang-off device 14 typically includes an inflatable retrieving buoy (not shown) for retrieval of the flexible transfer hose 22, if needed. The attachment of the flexible transfer hose 22 to the offshore platform 10 is arranged such that the emergency disconnection system for the flexible transfer hose 22 may be activated either from the offshore production platform 10 or from the DPFSO 20. To prevent having the flexible transfer hose 22 become entangled with the mooring or stabilization system 12 for the offshore production platform 10, the inflatable buoy may be used to prevent the flexible transfer hose 22 from sinking during regular or emergency disconnection.

Figure 3:
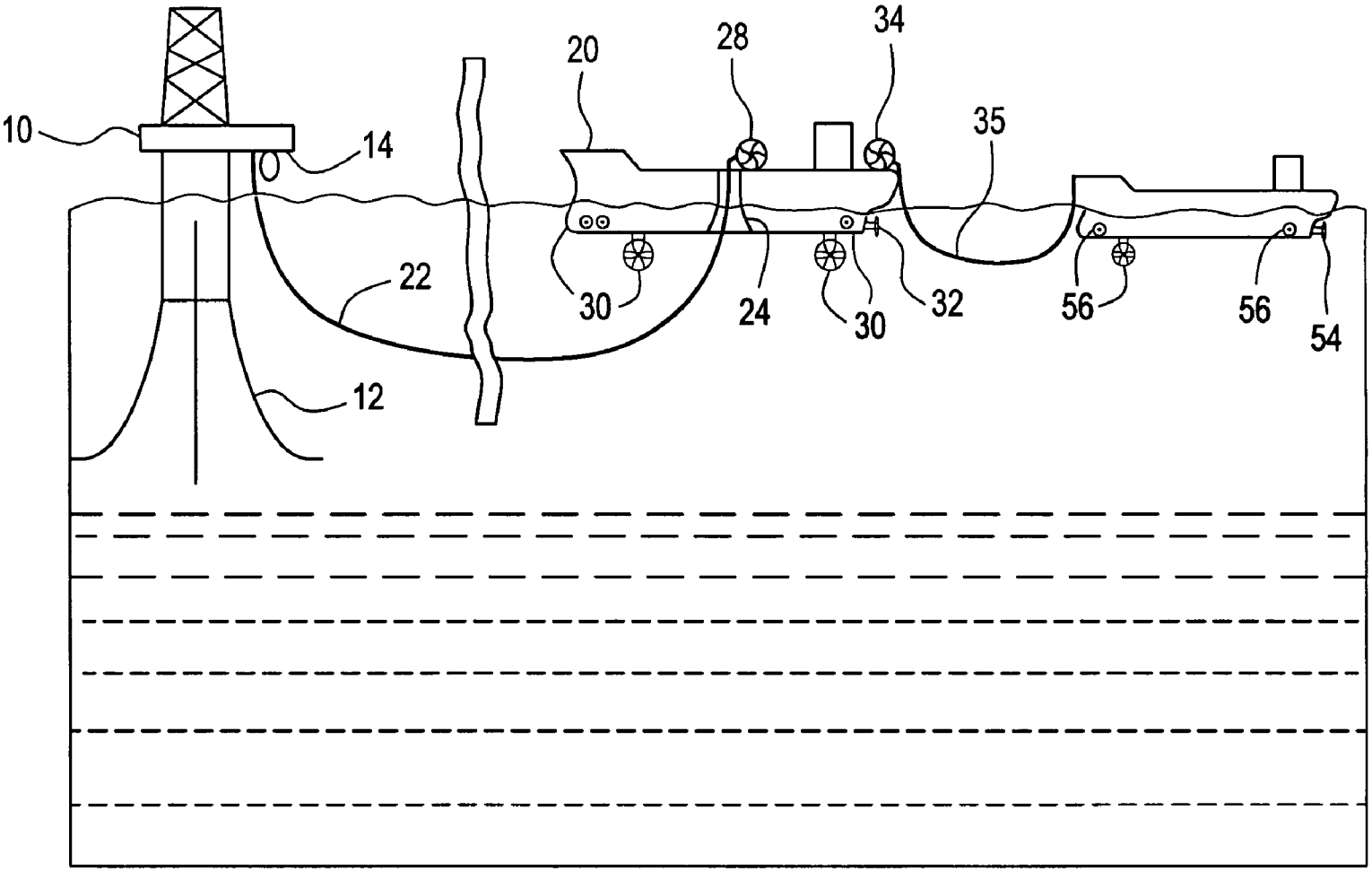
FIG. 3 is a schematic elevational view of FIG. 2.
Figure 4:
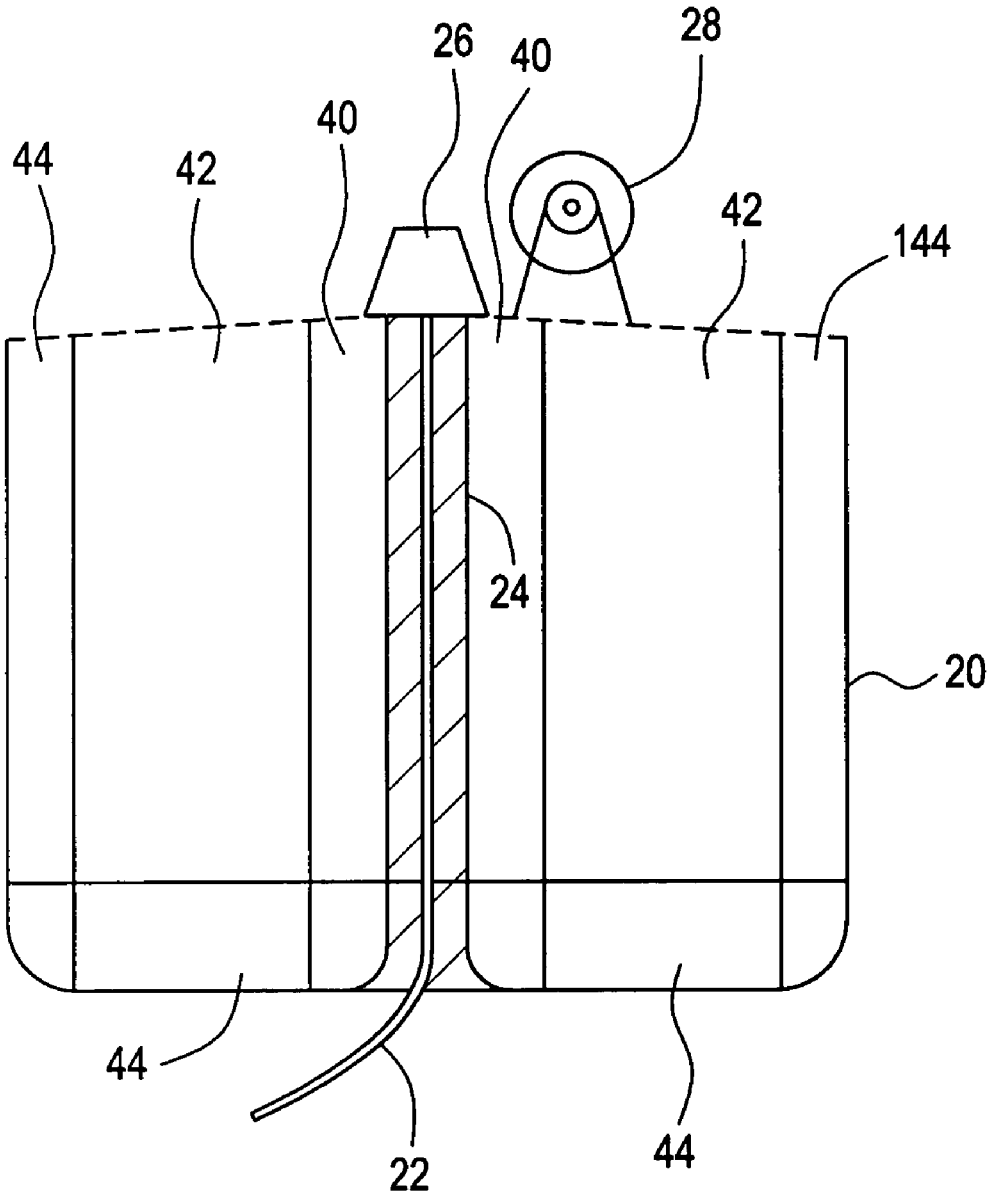
FIG. 4 is a cross-sectional view of a DPFSO taken at line 4—4 in FIG. 3.

The flexible transfer hose 22 includes shut-off valves to prevent oil spills during emergency disconnection. As shown in FIGS. 3 and 4, the flexible transfer hose 22 enters the DPFSO 20 through the bottom of the moon pool 24 to avoid any interference with the platform mooring system 12. On the deck of the DPFSO 20 is a rotational storage reel 28 connected to the downstream end of the flexible transfer hose 22. During normal operating conditions, the downstream end of the flexible transfer hose 22 will remain permanently connected to the DPFSO 20. When the flexible transfer hose 22 is disconnected at the production platform 10, the flexible transfer hose 22 will be rolled up onto the storage drum located on the deck of the DPFSO 20.

The DPFSO 20 is maintained in a locus of predetermined locations with respect to the offshore production platform 10 by a sophisticated dynamic positioning system. This sophisticated dynamic positioning system includes a combination of tunnel and/or azimuth thrusters 30, located at the bow and around the hull of the DPFSO 20. These thrusters 30 work in combination with the ship's main propeller and rudder system 32. The tunnel and/or azimuth thrusters 30 and the main propeller and rudder system 32 are controlled by a dynamic positioning computer. Within the dynamic positioning computer is built-in redundancy. To always keep the DPFSO 20 in the right position, one or more positional reference systems may be used. For example, if the DPFSO 20 is located in the Gulf of Mexico, the positional reference system will either be satellite based and/or microwave based. It is important to have several types of positional reference systems to both cross check for accuracy and to assure that at least one system for assuring proper location of the DPFSO 20 is always providing the required input to the thrusters 30 and the main propulsion and rudder system 32.

Figure 2:
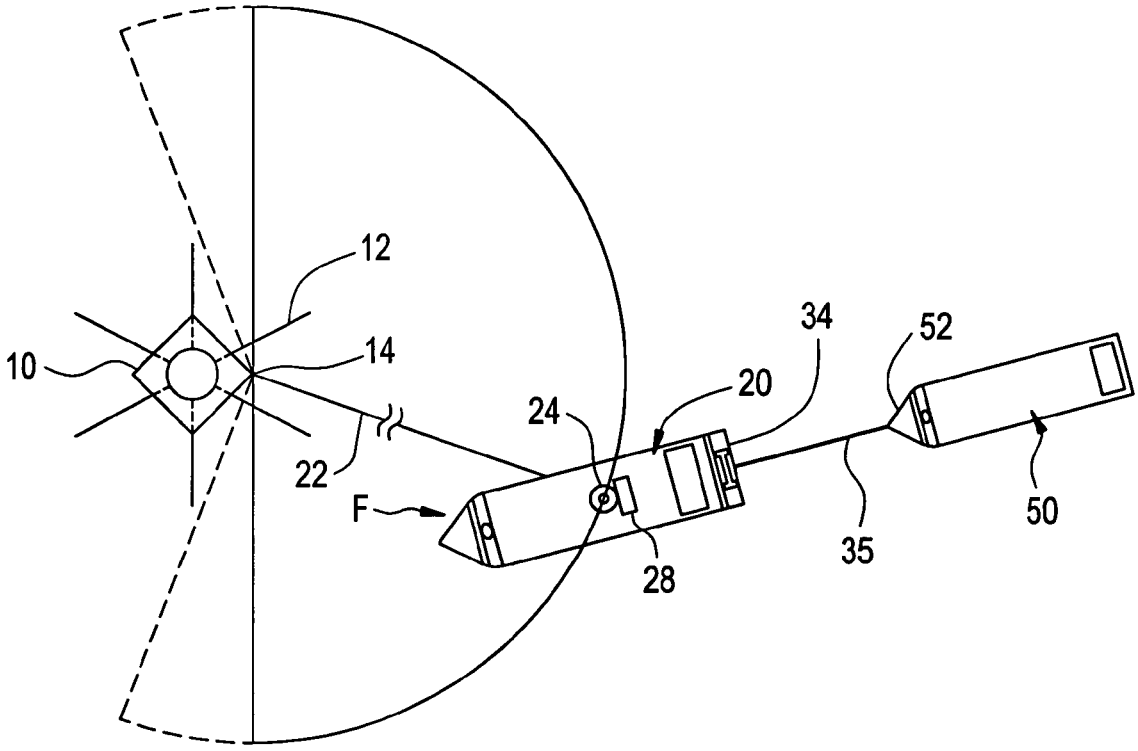
FIG. 2 is a schematic plan view, similar to FIG. 1, showing the position of a shuttle tanker relative to the DPFSO in the transfer mode.

As shown in FIG. 2 and in FIG. 3, a flexible discharge hose 35, typically a 16 inch diameter hose, is used to offload crude oil from the DPFSO 20 to a shuttle tanker 50. The hose 35 is stored on a drum 34, typically at the aft end of the DPFSO 20 when the DPFSO 20 is in its "receiving mode" with respect to an offshore platform 10.

FIG. 2 is a plan view of the system 100 of the present invention when the DPFSO 20 is in a "Discharge Mode" with respect to a shuttle tanker 50. Note that FIG. 2 is similar to FIG. 1, but there are two distinct differences.

The DPFSO 20 has changed its dynamic positioning operation from a "weather vane" mode to a dynamic positioning operation in "Auto Position" In the Auto position, the computer controlled dynamic positioning system locks the position of the DPFSO 20 with respect to its heading and with respect to the sea bottom. This is the typical operation mode that will be used for the DPFSO 20 when it is in Discharge Mode with respect to a shuttle tanker 50. The DPFSO 20, using the dynamic positioning system, will always be able to control its angular position with respect to the shuttle tanker 50 and its separation distance from the shuttle tanker 50 if wind, current or wave forces change directions after the unloading of crude oil to the shuttle tanker 50 has started.

The crude oil is unloaded from the DPFSO 20 to the shuttle tanker 50 that is positioned in a location aft of the DPFSO 20 in a so-called "tandem loading" configuration. The shuttle tanker 50 will typically be a smaller tanker whose position is also controlled with a dynamic positioning system that keeps the shuttle tanker 50 at a constant operating distance with respect to the DPFSO 20. The dynamic positioning systems on board both the DPFSO 20 and the shuttle tanker 50 are in communication with one another to maintain a constant separation distance, typically 100 meters.

The offloading operations from the DPFSO 20 to the shuttle tanker 50 are begun by the shuttle tanker 50 approaching the DPFSO 20 based on communications between the captain of the shuttle tanker 50 and the captain of the DPFSO 20. As the shuttle tanker 50 approaches the aft end of the DPFSO 20, a messenger line is shot from the DPFSO 20 to the shuttle tanker 50. Using the messenger line, a heavy wire/rope line is winched over onto the shuttle tanker 50 from the DPFSO 20. Using the wire/rope line, the flexible discharge hose 35 is pulled over to the shuttle tanker 50 from the DPFSO 20. When the end of the flexible discharge hose 35 is on board the shuttle tanker 50, the downstream end of the flexible discharge hose 35, now on the deck of the shuttle tanker 50, is affixed to the bow connection system 52 of the shuttle tanker 50. The shuttle tanker 50 is maintained both in a predetermined angular relationship and at a predetermined separation distance relative to the DPFSO 20 using the on-board dynamic positioning system of the shuttle tanker 50 that controls the tunnel/azimuth thrusters 56, located around the hull of the shuttle tanker 50 and the rudder and main propeller system 54 of the shuttle tanker 50.

Normally the shuttle tanker 50 will use its dynamic positioning system to "weather vane" during the loading of crude oil. If the external forces of the wind and waves change direction during the off-loading of crude oil such that the angle between the DPFSO 20 (staying in the dynamic positioning mode "Auto Position") and the shuttle tanker 50 increases more than prescribed in the standard operating procedures, the shuttle tanker 50 must request that the DPFSO 20 change its heading such that the angular relationship between the two vessels stays within the limits described in the standard operating procedures. Directional changes of the DPFSO 20 heading during loading period may also occur due to other reasons. Any repositioning of the DPFSO 20 requires dialog between responsible officers on the DPFSO 20 and the shuttle tanker 50.

Because of the use of the dynamic positioning systems on each vessel, normally no separate wire rope or hawser connection will be required between the DPFSO 20 and the shuttle tanker 50 to maintain a predetermined separation distance; however, a wire rope or hawser can be used between the two vessels if desired.

FIG. 3 shows the greater detail of the "discharge mode" shown in FIG. 2, in an elevational view. Specifically, FIG. 3 shows how the flexible transfer hose 22 between the offshore production platform 10 and the DPFSO 20 from the hang-off 14 on the production platform 10. FIG. 3 also shows how the flexible transfer hose 22 between the offshore production platform 10 and the DPFSO 20 and the flexible discharge hose 35 between the DPFSO 20 and the shuttle tanker 50 is configured and connected to the DPFSO 20 through the moon pool 24.

FIG. 4 shows further detail of the midship section of the DPFSO 20. The moon pool 24 passes upwardly generally through the center of the DPFSO 20. The flexible transfer hose 32 from the offshore production platform 10 is pulled through the moon pool 24. The moon pool 24 is typically formed in a trumpet shape including a bell portion at the bottom to avoid unnecessary wear on the flexible transfer hose 22 from the production platform 10. A hang-off device 26 is used to hang the flexible transfer hose 22 from the DPFSO 20 during normal operations. A drum 28 is used to store the flexible transfer hose 22 when the flexible transfer hose 22 is disconnected from the offshore production platform 10. The hang-off device 17 and the storage drum 28 are located in close proximity to the top of the moon pool 24. The DPFSO 20 includes a cargo tank center 40, and wing cargo tanks 42. Ballast tanks 44 are used in both the shipside and in the bottom of the DPFSO 20.

Key characteristics of the crude oil transportation system of the present invention are:

- The ability to extract crude oil from deep-water reservoirs without connection to subsea pipelines.
- The use of a dynamically positioned (DP) vessel as a crude oil storage and production facility.
- The ability to position a DPFSO on the leeward side of a production platform so that wind forces or sea currents will not cause the DPFSO to move into the offshore production platform.
- The ability of the DPFSO to connect to and be disconnected from the offshore production platform with very little assistance from the offshore production platform.
- The ability of the DPFSO to connect to and be disconnected from a shuttle tanker with very little assistance from the shuttle tanker.
- The use of simple hook-up and connection equipment at the offshore production platform, as most of the complex connection equipment is installed on the DPFSO.
- Storage of the flexible connection hose and storage of the flexible transfer hose on drums is located on the DPFSO for all disconnections, planned or emergency.
- The DPFSO is flexible to rotate a full 360 degrees around its centrally located moon pool.
- The DPFSO can function as storage vessel during weather conditions up to maximum loop current.

While the present system and method has been disclosed according to the preferred embodiment of the invention, those of ordinary skill in the art will understand that other embodiments have also been enabled. Such other embodiments shall fall within the scope and meaning of the appended claims.

What is claimed is:

1. A system for transporting crude oil from an offshore production platform, said transportation system comprising:

a dynamically positionable floating crude oil storage and offloading vessel, including a moon pool;

a flexible transfer hose for connecting the offshore production platform to said dynamically positionable floating crude oil storage and offloading vessel, said flexible transfer hose being located on said dynamically positionable floating crude oil storage and offloading vessel and constructed and arranged for passage through said moon pool;

at least one dynamically positionable shuttle tanker;

a flexible discharge hose for connecting to the dynamically positionable floating crude oil storage and offloading vessel to said dynamically positionable shuttle tanker, said flexible discharge hose being located on said dynamically positionable floating crude oil storage and offloading vessel;

wherein during a receiving mode, said dynamically positionable floating crude oil storage and offloading vessel is maintained in a predetermined locus of points with respect to the offshore production platform;

wherein during a discharge mode, said dynamically positionable floating crude oil storage and offloading vessel offloads crude oil into said dynamically positionable shuttle tanker, said dynamically positionable floating crude oil storage and offloading vessel and said dynamically positionable shuttle tanker are maintained at a predetermined angular relationship and separation distance from one another.

2. The system as defined in claim 1 further including a hang-off device for said flexible transfer hose and a storage reel for said flexible transfer hose in close proximity to said moon pool.

3. The system as defined in claim 1, wherein said floating crude oil storage and offloading vessel uses a computer controlled combination of an auxiliary positioning system and the main propulsion system of said crude oil storage and offloading vessel to maintain its position in a predetermined locus of points with respect to the offshore production platform.

4. The system as defined in claim 1, wherein said shuttle tanker uses a computer controlled combination of an auxiliary positioning system and the main propulsion system of said shuttle tanker to maintain its angular relationship and separation distance from said floating crude oil storage and offloading vessel.

5. A method for transporting crude oil from an offshore production platform, said method comprising the steps of:

dynamically positioning a floating crude oil storage and offloading vessel in a predetermined locus of points with respect to the offshore production platform;

connecting the offshore production platform to said floating crude oil storage and offloading vessel using a flexible transfer hose which passes through a moon pool in said floating crude oil storage and offloading vessel;

dynamically positioning shuttle tanker with respect to said floating crude oil storage and offloading vessel;

connecting the shuttle tanker to said floating crude oil storage and offloading vessel with a flexible discharge hose;

transferring crude oil from the offshore production platform to said floating crude oil storage and offloading vessel, thence to said shuttle tanker.

* * * * *